US006042158A

United States Patent [19]

Horn

[11] Patent Number: 6,042,158

[45] **Date of Patent: *Mar. 28, 2000**

[54] DROP-CATCH MECHANISM FOR VERTICALLY MOVABLE DOORS

[75] Inventor: John R. Horn, Dubuque, Iowa

[73] Assignee: Rite-Hite Holding Corporation, Milwaukee, Wis.

[ * ] Notice: This patent issued on a continued prosecution application filed under 37 CFR 1.53(d), and is subject to the twenty year patent term provisions of 35 U.S.C. 154(a)(2).

[21] Appl. No.: 08/812,438

[22] Filed: Mar. 7, 1997

[51] Int. Cl.[7] ..... E05C 1/12

[52] U.S. Cl. ..... 292/165; 292/DIG. 36; 292/DIG. 65; 160/201; 49/322; 16/DIG. 20

[58] Field of Search ..... 160/201; 49/322, 49/272, 379; 16/DIG. 20, 90; 292/34, 165, 177, 182, DIG. 36, DIG. 65

[56] References Cited

U.S. PATENT DOCUMENTS

| | | | |
|---|---|---|---|
| 1,113,667 | 10/1914 | Mahaj | 292/164 |
| 1,615,120 | 1/1927 | Fischer . | |
| 1,936,269 | 11/1933 | Schaffert et al. . | |
| 2,064,470 | 12/1936 | Heckman | 16/95 R |
| 2,084,677 | 6/1937 | Gerken . | |
| 2,095,695 | 10/1937 | Greegor . | |
| 2,102,373 | 12/1937 | Moittie | 292/33 |
| 2,185,828 | 1/1940 | Blodgett . | |
| 2,238,963 | 4/1941 | Bayer | 292/231 |
| 2,643,714 | 6/1953 | Wolf | 160/191 |
| 2,651,817 | 9/1953 | Moler . | |
| 2,703,247 | 3/1955 | Wolf et al. | 292/220 |
| 2,770,005 | 11/1956 | Smith | 292/133 |
| 2,869,183 | 1/1959 | Smith | 49/322 |
| 3,188,698 | 6/1965 | Zoll et al. . | |
| 3,258,062 | 6/1966 | Lambert | 292/DIG. 36 |
| 3,276,165 | 10/1966 | Purchell . | |
| 3,579,910 | 5/1971 | Wetter . | |
| 3,747,274 | 7/1973 | Moorman et al. | 49/280 |
| 4,080,757 | 3/1978 | Westerman | 292/166 |
| 4,385,471 | 5/1983 | Gabry et al. . | |
| 4,502,246 | 3/1985 | Minami | 49/322 |
| 4,520,591 | 6/1985 | Calvagno | 49/322 |
| 4,604,828 | 8/1986 | Baarse . | |
| 5,291,686 | 3/1994 | Sears et al. . | |

FOREIGN PATENT DOCUMENTS

| | | | |
|---|---|---|---|
| 612296 | 11/1960 | Italy | 160/202 |
| 7401386 | 8/1975 | Netherlands | 160/202 |
| 220463 | 9/1965 | Russian Federation | 160/202 |
| 819033 | 5/1981 | U.S.S.R. | 16/DIG. 20 |
| 8075 | 10/1914 | United Kingdom | 292/165 |

*Primary Examiner*—Darnell Boucher
*Attorney, Agent, or Firm*—Marshall, O'Toole, Gerstein, Murray & Borun

[57] ABSTRACT

A drop-catch mechanism for a vertically movable door is provided for preventing the free-fall of the door in doorway guides when a counterbalancing mechanism for the door malfunctions and a tensioning member for the counterbalancing mechanism becomes slack or loses tension. The drop-catch mechanism includes a plunger element, disposed within the door adjacent one of the lateral edges thereof. The plunger element is movable between a retracted position and an extended position where the outboard end extends from within the door and engages a guide. The drop-catch mechanism also includes an actuator crank having a portion rotatably mounted within the door, and operably coupled through a camming element to the plunger element, and having a portion extending through an aperture in the door face with a rotatable external leg coupled to the tensioning member for maintaining the plunger element in the retracted position. When the tensioning member is taut, it biases the plunger element to the retracted position. When the tensioning member is slack, however, the actuator moves the plunger element towards the extended position where it engages an engagement member arranged within the guide to arrest downward movement.

26 Claims, 5 Drawing Sheets

DROP-CATCH MECHANISM FOR VERTICALLY MOVABLE DOORS

FIELD OF THE INVENTION

The present invention relates generally to industrial doors and, more particularly, to a drop-catch mechanism for preventing the free-fall of a vertically movable door when a counterbalancing mechanism for the door malfunctions and a tensioning member for the counterbalancing mechanism becomes slack or loses tension.

BACKGROUND OF THE INVENTION

A wide variety of vertically movable doors are currently used in industrial and other settings. For example, one type of vertically movable door comprises a conventional sectional door having of a series of hingedly attached panels with rollers disposed on opposed lateral edges. Such sectional doors are typically movable between a closed or blocking position and an open or storing position relative to a doorway. For this purpose, a curved guide track—having a substantially vertical portion disposed adjacent to the doorway opening, a substantially horizontal portion disposed above and behind the doorway, and an intermediate curved portion—is provided on either side of the doorway for receiving the rollers of the panels. In this way, the door is substantially horizontal when in the storing position. Another type of vertically movable door is a vertically-storable door which moves in a continuous plane between the blocking and storing positions along substantially straight and vertical guide tracks.

Still other types of vertically movable doors are also available. For example, slat-style doors include a plurality of hingedly attached metal strips or extension members which engage and move along guide tracks arranged on either side of the doorway. In the stored position, these metal strips are rolled-up onto a tube which is disposed above the doorway. Fabric-style doors are also available. Such doors typically include a rigid bottom bar or extension member disposed along the bottom edge of a fabric panel which engages guide tracks arranged on either side of the doorway. In operation, these tracks guide the bottom bar as the door moves between the blocking and stored positions.

With most vertically movable doors, a counterbalancing device is provided for counteracting the effect of gravity on the door as it move between the blocking and storing positions. Such counterbalancing devices typically include a cable system which is attached to the door and a spring which is operatively connected to the cable system. When the door moves from the storing position, the spring becomes stressed and provides a force which counteracts the weight of the door. In this way, the spring controls the descent of the door as it moves towards the doorway-blocking position. Conversely, when the door is raised from the doorway-blocking position, the spring provides a lifting force which makes the door easier to raise.

If the counterbalancing mechanism fails and/or the cable losses tension or becomes slack, however, the spring becomes inoperative as a counterbalance and the door is no longer prevented from free-falling from the storing position. For this reason, some vertically movable doors are provided with a safety mechanism which halts the downward movement of the door should the cable break or should some other failure cause a loss of cable tension. Such safety mechanisms, however, suffer from some noted disadvantages including, for example, general unreliability, fragility, excessive cost, and inconvenient or awkward operation.

OBJECTS OF THE INVENTION

Accordingly, a general object of the present invention is to provide a drop-catch mechanism which prevents the free-fall of a vertically movable door when a counterbalancing mechanism for the door malfunctions.

A more specific object of the present invention is to provide a drop-catch mechanism which arrests the downward movement of the vertically movable door when a tensioning mechanism or cable for counterbalancing mechanism becomes slack or loses tension.

A related object of the present invention is to provide a drop-catch mechanism for a vertically movable door which reliably and safely prevents the door from falling to the ground when the cable loses tension or the counterbalancing mechanism otherwise malfunctions.

A further object of the present invention is to provide a drop-catch mechanism having the foregoing characteristics which is reliable, durable, and convenient to use.

These and other objects, features, and advantages of the present invention will become apparent upon reading the following detailed description of a preferred exemplified embodiment and upon reference to the accompanying drawings.

SUMMARY OF THE INVENTION

Accordingly, a drop-catch mechanism for a vertically movable door is provided for preventing the free-fall of the door when a counterbalancing mechanism for the door malfunctions. More specifically, the inventive drop-catch mechanism halts the downward movement of the door when a cable or other tensioning member for the counterbalancing mechanism becomes slack or loses tension. The drop-catch mechanism is intended for use with a vertically movable door having opposed lateral edges, at least one extension member which extends between the lateral edges, guiding or lateral end members such as rollers which engage one or more guide tracks mounted on opposed sides of a doorway, and a counterbalancing mechanism with a cable or other tensioning member which controls the movement of the door between open and closed positions relative to the doorway.

The inventive drop-catch mechanism includes a plunger element disposed adjacent to one of the lateral edges of the door or a given extension member. In use, the plunger element is movable between a retracted position, wherein an outboard end of the plunger element is spaced-apart from the guide track of the door, and an extended position, wherein the outboard end engages the guide track. The inventive drop-catch mechanism also includes an actuator operably coupled to the plunger element and to the tensioning member of the counterbalancing mechanism for selectively moving the plunger element between the retracted and extended positions. When the tensioning member is taut, the tensioning member biases the plunger element in the retracted position. When the tensioning member is slack, however, the actuator moves the plunger element towards the extended position where the outboard end engages one of a plurality of engagement members arranged within a channel of the guide track. In this way, the downward movement of the door is arrested before it reaches the closed position. The inventive drop-catch mechanism may also be provided with a biasing element, attached to the actuator and the door, for positively biasing the plunger element towards the extended position when tension in the tensioning member is lost.

BRIEF DESCRIPTION OF THE DRAWINGS

In the drawings, wherein similar reference numerals denote similar elements throughout the several views.

While the present invention will be described and disclosed in connection with certain preferred embodiments and procedures, the intent is not to limit the present invention to these specific embodiments. On the contrary, the intent is to cover all such alternatives, modifications, and equivalents that fall within the spirit and scope of the present invention as defined by the appended claims.

DETAILED DESCRIPTION OF THE PREFERRED EMBODIMENT

Figure 4:
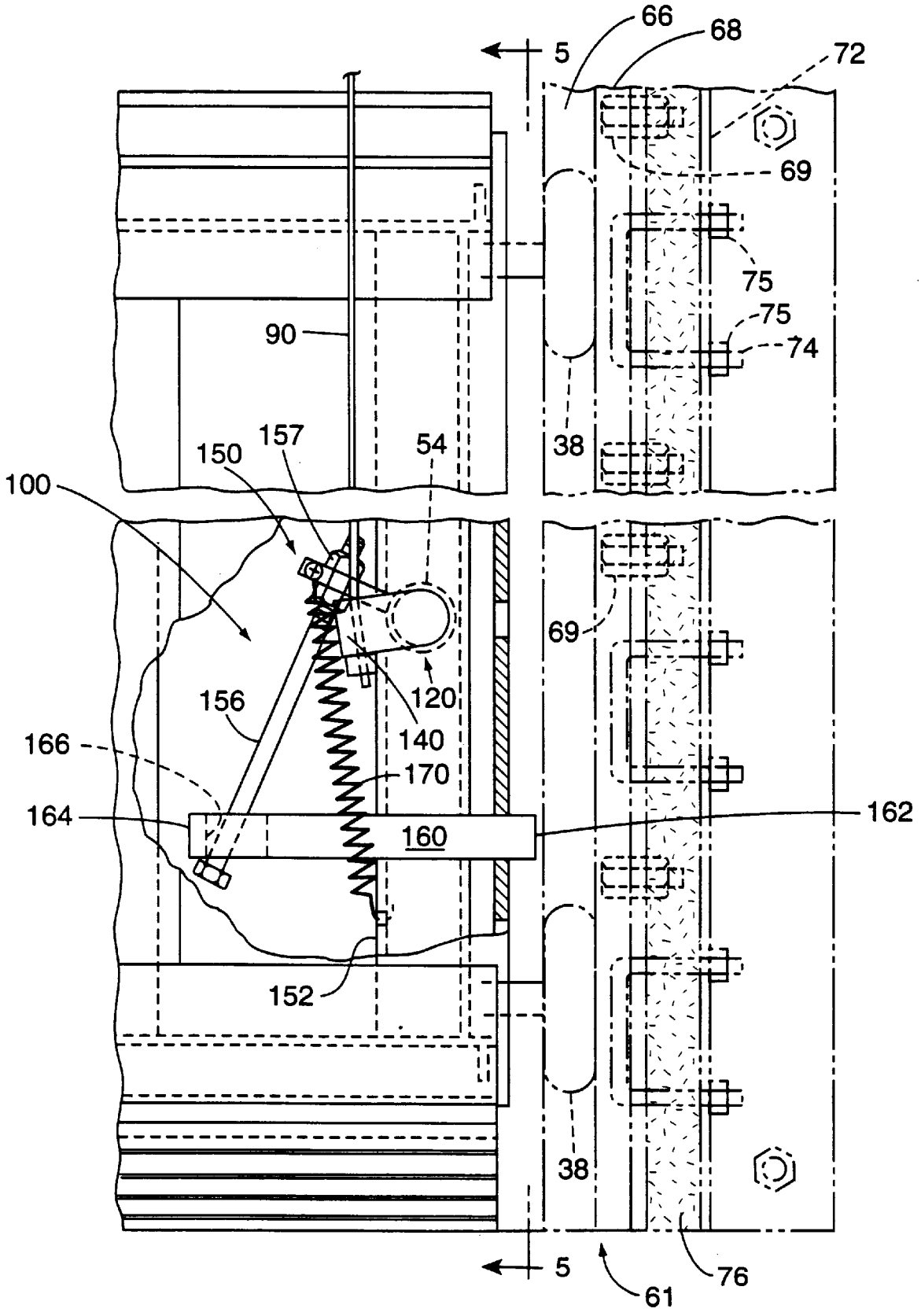
FIG. 4 is a partially fragmentary front side view of the door depicted in FIG. 1, showing a plunger element of the drop-catch mechanism in a retracted position.
Figure 6:
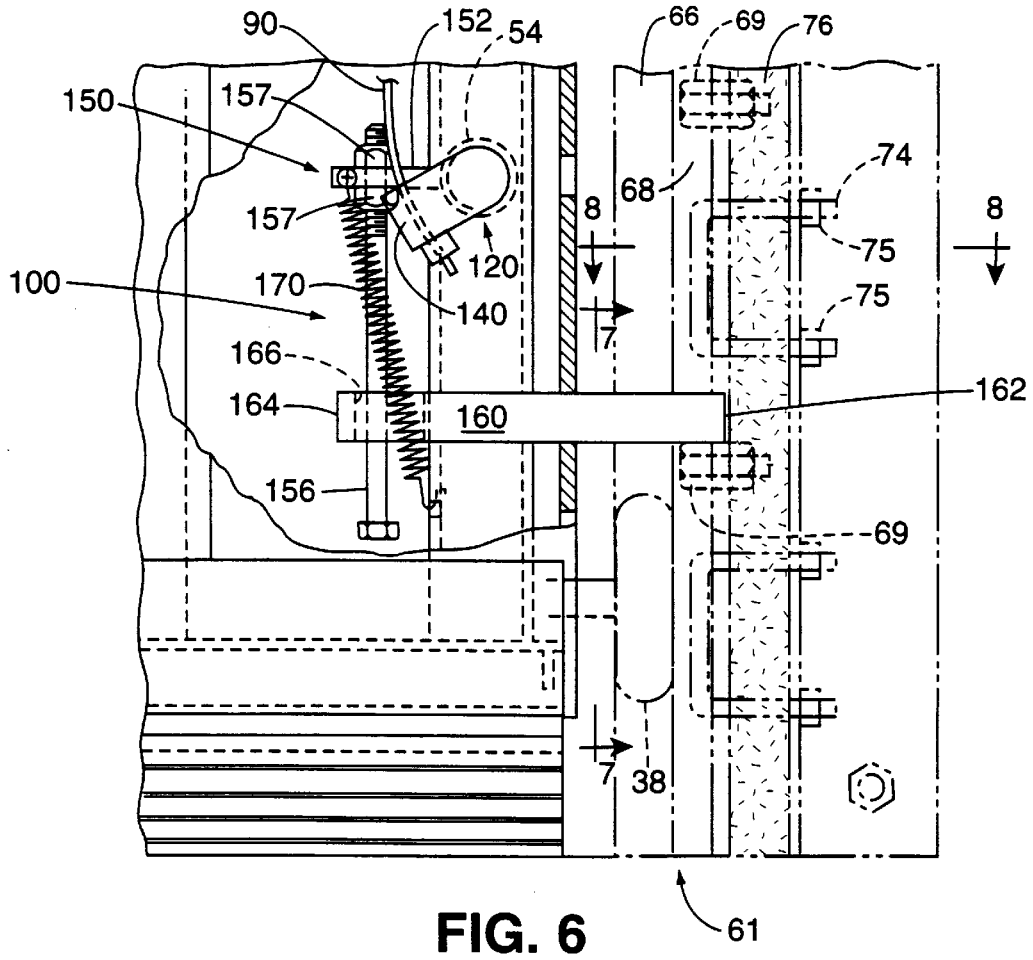
FIG. 6 is a partial fragmentary front side view of the door depicted in FIG. 1, showing the plunger element of the drop-catch mechanism in an extended position and engaging a bolt mounted within a guide track for the door.
Figure 8:
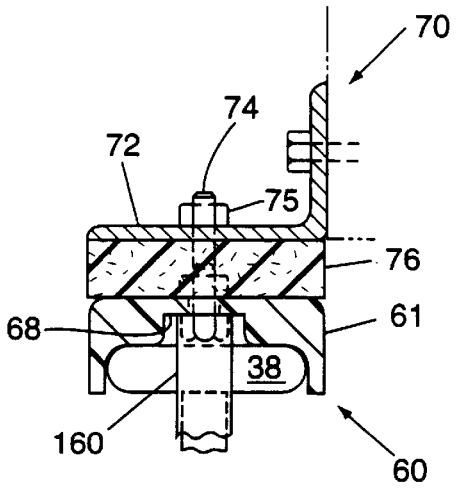
FIG. 8 is a cross-sectional view of the guide track and roller as seen in the direction of line 8—8 of FIG. 7.

Turning now to the drawings, an inventive drop-catch mechanism for an industrial door 20 is designated generally by reference numeral 100. As is customary in the art, the door 20 includes an outer face portion 32, an inner face portion 34, and opposed lateral edges 36. The door 20 is also movable relative to a doorway 10 between a closed or blocking position—as shown, for example, in FIG. 1—and an open or storing position—as shown, for example, in FIG. 2. In the illustrated embodiment, the door 20 comprises a plurality of hingedly attached panels or extension members 30 which extend between the opposed lateral edges 36 of the door 20. A plurality of side-mounted guiding elements or lateral end members in the form of rollers 38 are positioned along the lateral edges 36 of the panels 30 for engagement with a pair of guide tracks 60 mounted on opposed sides 12 of the doorway 10. In the illustrated embodiment, each guide track 60 includes a first portion 61 which extends substantially vertically along the sides 12 of the doorway 10, a second overhead portion 62 which extends substantially horizontal with respect to the doorway 10, and a curved portion 63 therebetween. As shown in FIGS. 4, 6, and 8, each guide track 60 also includes an internal guideway 66 for receiving the guiding members or rollers 38 of the door 20, and a centrally disposed channel 68 which runs at least along the full length of the first portion 61.

Figure 2:
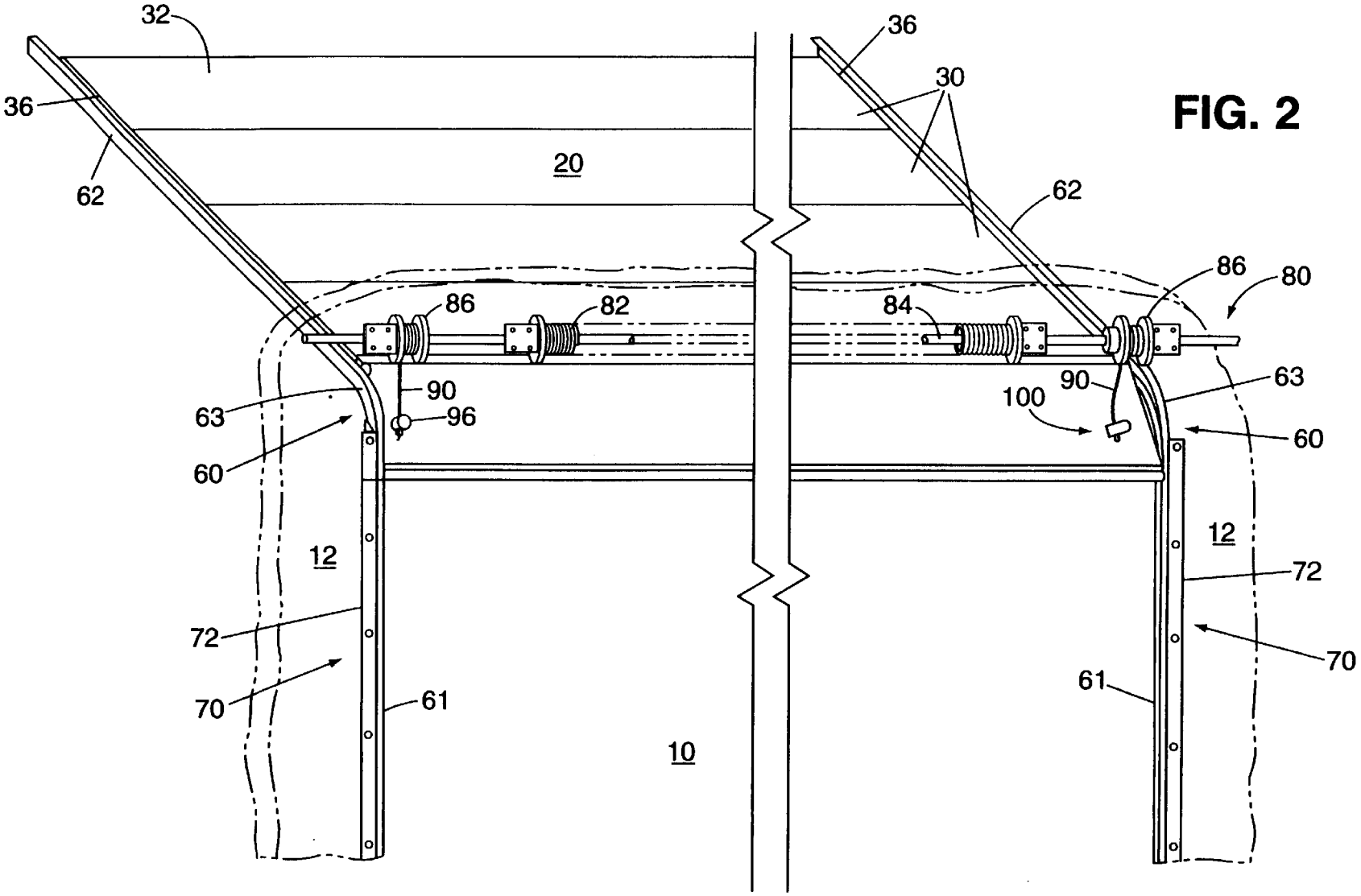
FIG. 2 is a perspective view of the door depicted in FIG. 1, with the door in an open or storing position.

Although the door 20 described and illustrated herein comprises a sectional door having a plurality of hingedly attached panels 30, it will be readily appreciated by those skilled in the art that the door 20 may take other forms without departing from the scope or spirit of the present invention. By way of non-limiting example, the door 20 may alternatively be in the form of a slat-style door having one or more metal strips or extension members which roll-up onto a tube, a fabric-style door having a rigid bottom bar or extension member disposed along its bottom edge, or a single panel door (i.e., a non-hinged door structure). It will also be appreciated that the guiding members or rollers 38 for the door 20 may take other forms including, for example, pins with rounded heads which are received by the guide tracks 60. Alternatively, the lateral edges 36 of the panels or extensions members 30 could form the guiding members by being directly received in the guide tracks 60. In addition, the guide tracks 60 may alternatively be completely straight and vertical, as opposed to curved. In this way, the door 20 may either have a substantially horizontal closed position, as shown in FIG. 2, or a substantially vertical closed position, as with vertically-storable doors.

As best shown in FIG. 8, each vertical portion 61 of guide track 60 is preferably supported by a frame 70 which, in the illustrated embodiment, is in the form of a mounting bracket 72. A plurality of spaced-apart U-bolts 74 and associated nuts 75 are used to couple the guide tracks 60 to the mounting brackets 72 through the channels 68 of the guideways 66. In order to permit the guide tracks 60 to move in response to applied forces and subsequently return to a normal operating position, a resilient member 76, formed of neoprene rubber or the like, may be disposed between the guide tracks 60 and the mounting brackets 72, as shown, for example, in FIG. 8. Of course, the guide tracks 60 may alternatively be directly attached to the mounting brackets 72 without the use of this intermediate resilient member 76.

Figure 1:
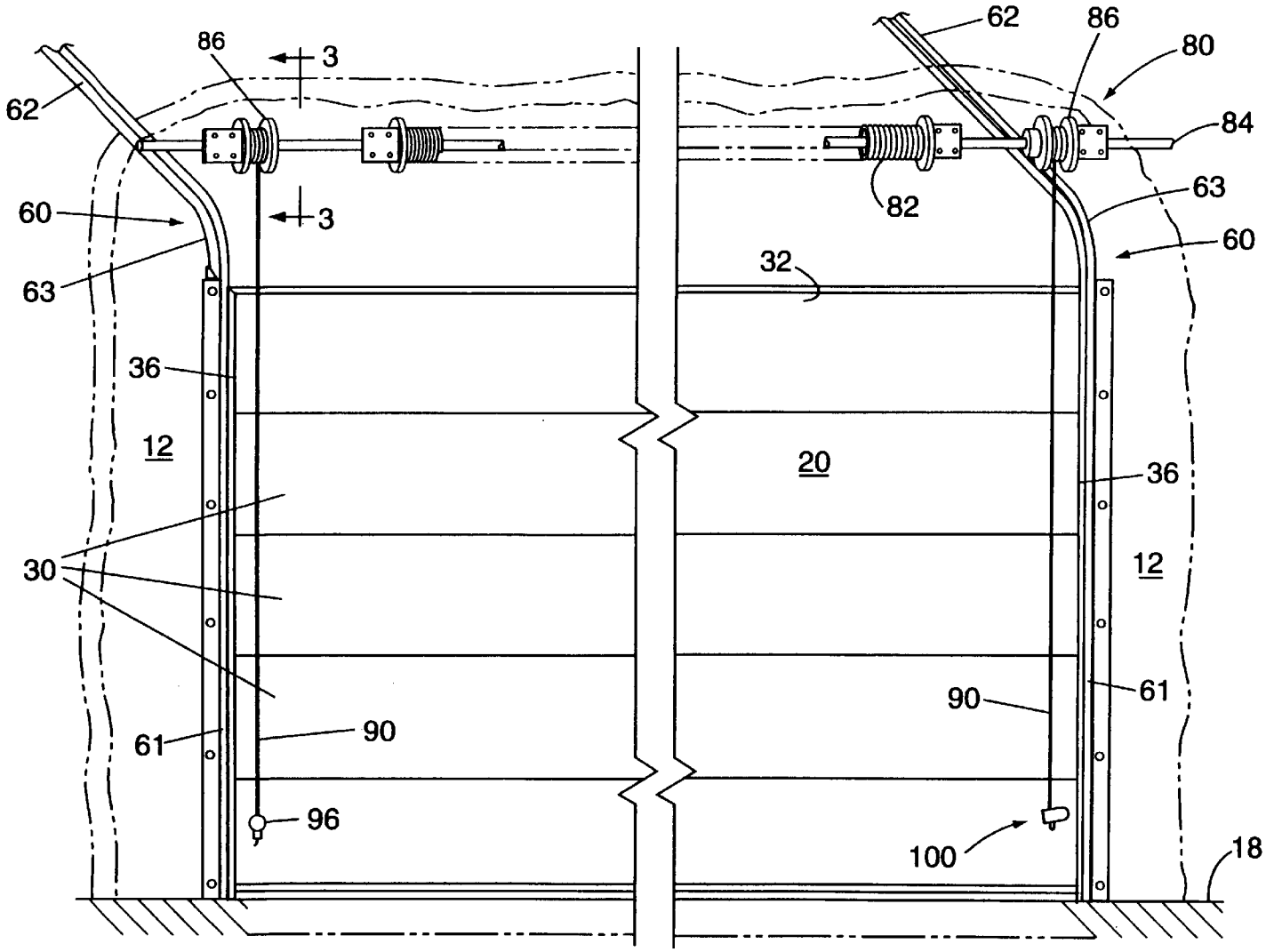
FIG. 1 is a perspective view of an industrial sectional door having a drop-catch mechanism constructed in accordance with the present invention and showing the door in a closed or blocking position.
Figure 3:
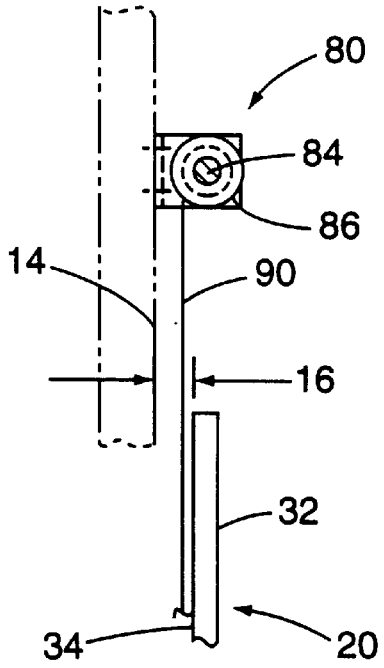
FIG. 3 is a partially fragmentary end view of the door and an attached counterbalancing mechanism as seen in the direction of line 3—3 of FIG. 1.

As is customary in the art, a counterbalancing mechanism 80 is provided for counteracting the effects of gravity on the door 20 as it moves between the open and closed positions. In the illustrated embodiment, the counterbalancing mechanism 80 comprises a helical torsion spring 82 which is mounted around a support shaft 84, a pair of spaced-apart spindles 86 which are mounted to the support shaft 84 on either side of the spring 86, and a pair of tensioning members 90 in the form of cables which are attached between the spindles 86 and the lowermost panel 30 of the door 20, as shown in FIGS. 1 and 2. More specifically, the support shaft 84 is rotatably mounted to a frame 14 above the doorway 10, the spindles 86 are substantially aligned with the opposed lateral edges 36 of the door 20, and the tensioning members or cables 90 are routed through a small gap 16 between the frame 14 of the doorway 10 and the outer face 32 of the door 10, as shown in FIG. 3. Although the tensioning members 90 are described herein as cables, it will be appreciated by those skilled in the art that other forms of tensioning members 90 may alternatively be used including, for example, cords, ropes, belts, chains, and the like.

In operation, the counterbalancing mechanism not only controls the descent of the door 20 as it moves downwardly from the open position, but also makes the door 20 easier to raise from the closed position. For example, when the door 20 moves towards the closed position, the support shaft 84 rotates about its axis, the cables 90 progressively unwind from the spindles 86, and the spring 82 become increasingly torsioned. This torsioning of the spring 82, in turn, causes the cables 90 to exert a force on the door 20 which partially counteracts its weight. In this way, the counterbalancing mechanism 80 controls the descent of the door 20 as it moves either by manual force, motive force, or gravity from the open position. Conversely, when the door 20 is lifted from the closed position, the energy stored in the spring 82 provides a restoring force which makes it easier to elevate the door 20. In both instances, tension is continuously maintained in the cables 90 as the door 20 moves between the open and closed positions. If, however, the cables 90 were to fail, become slack, or otherwise lose tension, the counterbalancing mechanism 80 would no longer be able to control the upward or downward movement of the door 20.

Although a counterbalancing mechanism 80 with a torsion spring 82 is specifically shown and described herein, it will be readily appreciated by those skilled in the art that virtually any type of counterbalancing mechanism may alternatively be used without departing from the scope or spirit of the present invention. For example, the counterbalancing mechanism 80 may instead include extension springs, compression springs, leaf springs, hanging counterweights, or the like. In any event, the drop-catch mechanism 100 of the present invention is intended for use with a counterbalancing mechanism having at least one tensioning member 90.

In accordance with an important object of the present invention, the inventive drop-catch mechanism 100 prevents the door 20 from free-falling when the cable 90 becomes slack or loses tension. For example, if the cable 90 attached to the inventive drop-catch mechanism 100 were to fail or the counterbalancing mechanism 80 were to malfunction in some other manner causing a loss of tension in the cable 90 while the door 20 was located above the closed position, the drop-catch mechanism 100 would safely halt the downward movement of the door 20 before it could plummet to the ground 18 in a manner which may cause damage to the door 20.

In the illustrated embodiment, the drop-catch mechanism 100 is arranged in the lowermost panel 30 of the door 20 in adjacent relationship with respect to one of the lateral edges 36 of the door 20. The drop-catch mechanism 100 also protrudes from the outer face portion 32 of the panel 30 and is attached to one of the cables 90. The other cable 90 is attached to the same panel 30 at substantially the same vertical height with a fastener or clasp 96. Although the drop-catch mechanism 100 is shown protruding from the outer face portion 32 of the lowermost panel 30, it will be readily appreciated by those skilled in the art that drop-catch mechanism 100 may alternatively be arranged in any panel 30 at almost any vertical height or protrude from the inner face portion 34 of the door 20 without departing from the scope or spirit of the present invention. The drop-catch mechanism 100 may also be disposed between the lateral edge 36 of the door 20 and the guide track 60. Of course, if the drop-catch mechanism 100 protrudes from the inner face portion 34 of the door 20, the cable 90 should instead be routed along the inside of the door 20 with a pulley system or the like. In addition, more than a single drop catch mechanism 100 may be provided for the door 20. For example, a pair of opposed drop-catch mechanisms 100 may be arranged on either side 36 of the door 20 for attachment with both cables 90.

Figure 5:
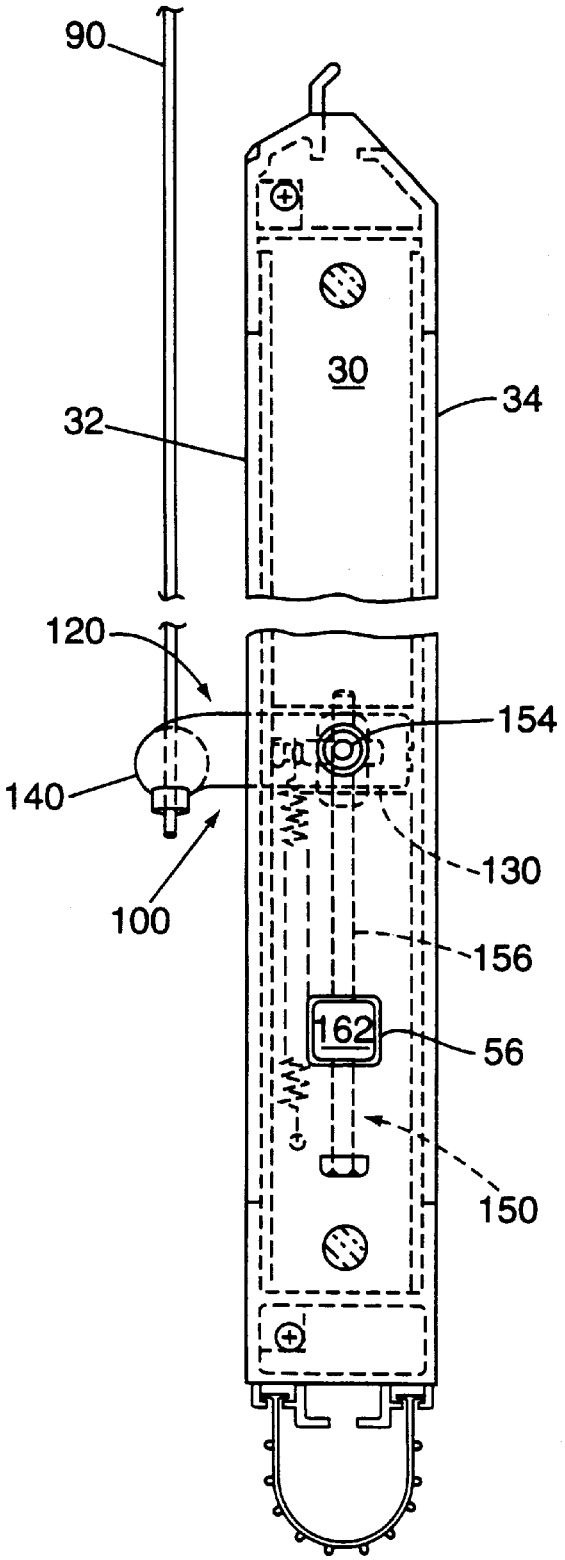
FIG. 5 is an end view of the door and drop-catch mechanism as seen in the direction of line 5—5 of FIG. 4.

As shown in FIGS. 4–6, the drop-catch mechanism 100 of the present invention is preferably arranged within an internal support frame 52 of the panel 30 and includes an actuator 120 to which the cable 90 of the counterbalancing mechanism 80 is attached. In the illustrated embodiment, the actuator 120 is in the form of crank member or pivot shaft having a proximal shank portion 130 which is pivotably received by a hole 54 formed in the support frame 52 of the panel 30, a distal leg portion 140 which is attached to the cable 90, and a camming element 150 which is fixedly attached to the proximal shank portion 130. More specifically, the crank member 120 is generally L-shaped, with the leg portion 140 extending at an angle with respect to the shank portion 130 as it protrudes from the door 20. Because of this configuration, the cable 90 exerts a torque on the crank member 120 when the cable 90 is taut or tensioned.

In operation, the crank member or actuator 120 is movable between a first rotatable position—as shown, for example, in FIG. 4—and a second rotatable position—as shown, for example, in FIG. 6. When the cable 90 is taut, the force exerted on the crank member 120 by the cable 90 biases the crank member 120 towards the first rotatable position. When the cable 90 becomes slack due to a malfunctioning of the counterbalancing mechanism 80 or cable 90, however, the crank member 120 is no longer biased towards the first rotatable position. Instead, a biasing element 170 exerts a force on the crank member 120 which biases it towards the second rotatable position. In the illustrated embodiment, the biasing element 170 is in the form of a helical coil spring, although other forms of biasing devices would certainly fall within the scope and spirit of the present invention. In addition, although a specific biasing element 170 is described and illustrated herein, it will be readily appreciated by those skilled in the art that the crank member 120 may alternatively be biased towards the second rotatable position by other means including, for example, by gravity.

As shown in FIGS. 4 and 6, the camming element 150 of the crank member 120 comprises a beam portion 152 which extends radially outwardly from the shank portion 130 of the crank member 120, and a rod portion 156 which is fixedly attached to the beam portion 152 in a generally downwardly direction. In this way, the rod portion 156 of the cam actuator 50 rotates in conjunction with the crank member 120. In the presently preferred embodiment, the beam portion 152 of the camming element 150 is affixed to the shank portion 130 of the crank member 120 by a set screw or bolt 154 which is received by a hole formed through the shank portion 130 of the crank member 120 and by an aligned threaded tap hole (not shown) formed in the beam portion 152 of the camming element 150. Of course, those skilled in the art will readily appreciate that the beam portion 152 of the camming element 150 may be affixed to the shank portion 130 of the crank member 120 by other means including, for example, by welding or the like. In the illustrated embodiment, the rod portion 156 of the camming element 150 is in the form of a threaded bolt which is received by a hole formed through beam portion 152. As shown in FIGS. 4 and 6, the threaded bolt 156 is affixed to the beam portion 152 by a pair of nuts 157 which engage opposed sides of the beam portion 152. Although the beam and rod portions 154 and 156 of the camming element 150 are described herein as individual articles joined together in a specific manner, it will be understood by those skilled in the art that these components may alternatively be in the form of other articles, be joined together in a different manner, be of a unitary construction, or have different shapes—so long as the camming element 150 rotates in conjunction with the crank member or actuator 120.

In accordance with an important aspect of the present invention, the drop-catch mechanism 100 is also provided with a movable plunger element 160 which interacts with and is moved by the camming element 150 when the actuator 120 is rotated between the first and second rotatable positions. In the illustrated embodiment, the plunger element 160 is slidably disposed within an aperture 56 formed through the internal support frame 52 and through the lateral edge 36 of the panel 30. More specifically, the plunger element 160 includes an outboard end 162 which protrudes through the aperture 56 of the panel 30 and an inboard end 164 with an internal camming surface or slot 166. As shown in FIGS. 4 and 6, the slot 166 of the plunger element 160 receives the rod portion 156 of the camming element 150. Thus, when the crank member 120 is moved between the first and second rotatable positions, the rod portion 156 of the camming element 150 causes the plunger element 160 to move between a retracted position wherein the outboard end 162 is spaced-apart from the guide track 60—as shown, for example, in FIG. 4—and an extended position wherein the outboard end 162 engages the channel 68 of the guide track 60—as shown, for example, in FIG. 6.

As mentioned above, the drop-catch mechanism 100 is also provided with biasing element 170 which positively biases the crank member 120 towards the second rotatable position. If tension in the cable 90 is lost during the operation of the door 20 (e.g., if the cable 90 fails or if the counterbalancing mechanism 80 malfunction in some other manner), this biasing element 170 causes the crank member 120 to move towards the second rotatable position which, in turn, causes the plunger element 160 to move towards the extended position. In the illustrated embodiment, the biasing element 170 is attached to the internal support frame 52 of the panel 30 and to the beam portion 152 of the camming element 150.

Figure 7:
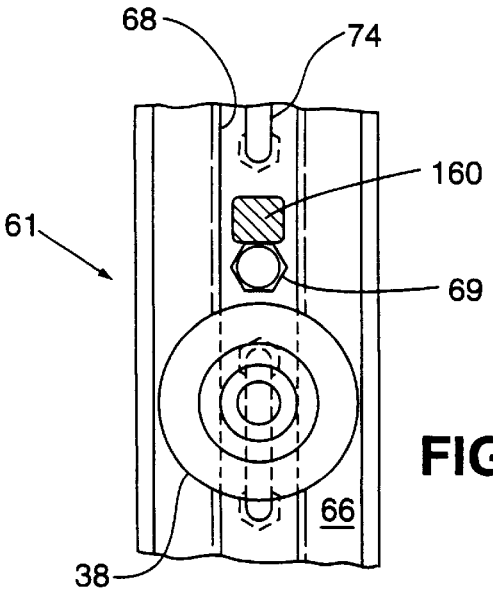
FIG. 7 is a partially, fragmentary, interior, elevational view of the guide track and a roller for the door as seen in the direction of line 7—7 of FIG. 6.

In order to prevent the free-fall of the door 20 when tension in the cable 90 is lost, a plurality of spaced-apart engagement members 69 in the form of lag bolts or the like are disposed within the channel 68 of the vertical portion 61 of the guide tracks 60, as shown in FIGS. 4, 6, and 7. Since the lag bolts 69 are arranged within channel 68 and not guideway 66, the guiding members or rollers 38 for the door 20 do not engage or otherwise interfere with these lag bolts 69. Although the engagement members 69 are described herein as lag bolts, it will be readily appreciated by those skilled in the art that the engagement members 69 may take other forms including, for example, attachable pegs, integral ridges or protuberances formed in the guide track 60, or any other implements, tools, or gadgets disposed in the guide tracks 60 which provide suitable engagement with the outboard end 162 of the plunger element 160 but do not interfere with the rollers or guiding members 38 of the door 20. For example, instead of engaging the lag bolts 69, the outboard end 162 of the plunger element 160 may alternatively engage one of the U-bolts 74 used to attach the guide track 60 to the frame 70.

In most instances, the outboard end 162 of the plunger element 160 never engages these lag bolts 68 because the cable 90 is normally taut which causes the plunger element 160 to remain in the retracted position. If, however, tension in the cable 90 is lost, the outboard end 162 of the plunger element 160 moves into the extended position and is received by the channel 68 of the guide track 60. Thus, if the door 20 is in a position above the closed position and the cable 90 becomes slack, the drop-catch mechanism 100 of the present invention operates in the following manner: the biasing element 170 moves the crank member 120 into the second rotatable position; the camming element 150 moves the plunger element 160 into the extended position and into engagement with the channel 68 of the internal guideway 66; and, as the door 20 descends, the outboard end 162 of the plunger element 160 engages the nearest downwardly disposed engagement member 69 or 74 which arrests the downward movement of the door 20 before it can strike the ground 18. By engaging these lag bolts 69 (or U-bolt 74) in this manner, the drop-catch mechanism 100 of the present invention advantageously prevents the free-fall of the door 20 when the tension in the cable 90 is lost.

Normally, both the cable 90 and the biasing element 170 exert generally opposed forces on the crank member 120 which maintains the crank member 120 in the first rotatable position. When tension in the cable 90 is lost, however, the force provided by the cable 90 disappears and the biasing member 170 moves the crank member 120 towards the second rotatable position. As described above, movement of the crank member 120 towards the second rotatable position causes the camming element 150 to drive the plunger element 160 towards the extended position and into the channel 68 of the guideway 66 where the outboard end 162 of the plunger element 160 engages the nearest downwardly disposed lag bolt 69 as the door 20 falls towards the closed position. Thus, when the cable 90 becomes slack, the downward movement of the door 20 is halted before it reaches the closed position by engagement between the outboard end 162 of the plunger element 160 and one of the lag bolts 69 (or U-bolts 74) of the guide track 60. In this way, the inventive drop-catch mechanism 100 advantageously prevents the door 20 from falling to the ground 18 in a possibly destructive manner when the counterbalancing mechanism 80 malfunctions and tension in the cable 90 is lost.

While the present invention has been described and disclosed with an emphasis upon preferred embodiments, it will be understood, of course, that the present invention is not strictly limited thereto. Since modifications may be made to the structures disclosed herein—particularly in light of the foregoing teachings—without departing from the present invention, the following claims are intended to cover all structures that fall within the scope and spirit of the present invention.

What is claimed is:

1. A drop-catch mechanism for use with a door which is movable between an open position and a closed position relative to a doorway defined by guide tracks, the door having opposed lateral edges, at least one extension member which extends between the opposed lateral edges, guiding members disposed along the opposed lateral edges each of which engages one of said guide tracks in the doorway, at least one of said guide tracks comprising a guideway and a channel, and a counterbalancing mechanism for counteracting the effect of gravity on the door and for controlling the movement of the door between the open and closed positions, the counterbalancing mechanism including a tensioning member, the drop-catch mechanism preventing free-fall of the door when tension in the tensioning member is lost, the drop catch mechanism comprising:

a plunger element with an outboard end adapted to be disposed adjacent one of the opposed lateral edges of the door, the plunger element being movable between a retracted position, wherein the outboard end is adapted to be spaced-apart from a guide track having a channel, and an extended position, wherein the outboard end is adapted to be engaged in said guide track; and an actuator operably coupled to the plunger element and to the tensioning member for moving the plunger element between the retracted and extended positions, the tensioning member biasing the plunger element towards the retracted position when tension is present therein and the actuator moving the plunger element towards the extended position when tension in the tensioning member is lost, the actuator including a crank member having a proximal shank portion which is adapted to be pivotably mounted in the door and a distal leg portion which extends substantially transversely from said shank portion and has a distal end which, when the drop-catch mechanism is mounted to the door, is attached to the tensioning member.

2. The drop-catch mechanism set forth in claim 1, including a plurality of spaced-apart engagement members adapted to be disposed in said guide track.

3. The drop-catch mechanism set forth in claim 2, wherein the outboard end of the plunger element is adapted to engage one of the engagement members of said guide track when the plunger element is in the extended position so as to prevent the free-fall of the door when tension in the tensioning member is lost.

4. The drop-catch mechanism set forth in claim 2, wherein the plurality of spaced-apart engagement members are adapted to be disposed in the channel of said guide track.

5. The drop-catch mechanism set forth in claim 2, wherein at least some of the spaced-apart engagement members are bolts.

6. The drop-catch mechanism set forth in claim 1, wherein the actuator further comprises a camming element extending substantially transversely of the shank portion which interacts with the plunger element.

7. The drop-catch mechanism set forth in claim 6, wherein the camming element is fixedly attached to the shank portion.

8. The drop-catch mechanism set forth in claim 6, wherein the camming element comprises a beam portion which extends outwardly from the shank portion of the crank member and a rod portion which is fixedly attached to the beam portion and is received by a slot formed in the plunger element.

9. The drop-catch mechanism set forth in claim 8, wherein the rod portion of the camming element is in the form of a threaded bolt which is fixedly attached to the beam portion by a pair of nuts.

10. The drop-catch mechanism set forth in claim 6, wherein the distal leg portion of the crank member extends at an angle with respect to the proximal shank portion.

11. The drop-catch mechanism set forth in claim 6, wherein the crank member has a generally L-shaped configuration.

12. The drop-catch mechanism set forth in claim 1, further comprising a biasing element adapted to be attached between the actuator and the door for biasing the plunger element towards the extended position when tension in the tensioning member is lost.

13. The drop-catch mechanism set forth in claim 12, wherein the biasing element comprises a helical coil spring.

14. A drop-catch mechanism for preventing free-fall of a movable door, the door having opposed lateral edges, at least one extension member which extends between the opposed lateral edges, lateral end members disposed along a lateral edge for engagement with a guide track mounted on a side of a doorway, said guide track having a guideway and a channel, and a counterbalancing mechanism with a tensioning member for counteracting the effect of gravity as the door moves between open and closed positions relative to the doorway, the drop-catch mechanism preventing the free-fall of the door when tension in the tensioning member is lost, the drop-catch mechanism comprising:

a plunger element with an outboard end disposed adjacent to one of the opposed lateral edges of the door, the plunger element being movable between a retracted position, wherein the outboard end is adapted to be spaced-apart from the guides track, and an extended position, wherein the outboard end is adapted to engage said guide track, the plunger element having a longitudinal axis;

an actuator adapted to be operably coupled to the plunger element and to the tensioning member for moving the plunger element between the retracted and extended positions, the tensioning member biasing the plunger element towards the retracted position when tension is present therein; and a biasing element adapted to be attached between the actuator and the door for generating a force to move the plunger element towards the extended position when tension in the tensioning member is lost, the force generated by the biasing element being directed in a direction which is at least partially transverse to the longitudinal axis of the plunger element.

15. The drop-catch mechanism set forth in claim 14, including a plurality of spaced-apart engagement members adapted to be disposed in said guide track.

16. The drop-catch mechanism set forth in claim 15, wherein the outboard end of the plunger element is adapted to engage one of the engagement members of said guide track when the plunger element is in the extended position.

17. The drop-catch mechanism set forth in claim 16, wherein downward movement of the door is arrested by engagement between the outboard end of the plunger element and said engagement member of said guide track.

18. The drop-catch mechanism set forth in claim 15, wherein the plurality of spaced-apart engagement members are adapted to be disposed in the channel of said guide track.

19. The drop-catch mechanism set forth in claim 15, wherein at least some of the spaced-apart engagement members are bolts.

20. The drop-catch mechanism set forth in claim 14, wherein the biasing element comprises a helical coil spring.

21. A drop-catch mechanism for use with a door which is movable between an open position and a closed position relative to a doorway, the door having opposed lateral edges, a plurality of rollers on each lateral edge which engage a guide track mounted on a side of the doorway, and a counterbalancing mechanism for counteracting the effect of gravity on the door as it moves between the open and closed positions, the counterbalancing mechanism including an extendable cable, the drop-catch mechanism comprising:

a crank member adapted to be pivotably mounted to the door for movement between first and second rotatable positions, the crank member including: (a) a proximal shank portion which is adapted to be disposed proximate to one of the lateral edges of the door, (b) a distal leg portion which extends substantially transversely from the proximal shank portion and which, when the drop-catch mechanism is mounted to the door, is attached to the cable of the counterbalancing mechanism so as to bias the crank member towards the first rotatable position, and (c) a camming element;

a plunger element adapted to be slidably disposed with respect to a lateral edge of the door, the plunger element including an inboard end, an outboard end, and a slot for receiving the camming element of the crank member, the camming element moving the plunger element when the crank member is moved between the first and second rotatable positions, the plunger element moving between a retracted position wherein the outboard end is adapted to be spaced-apart from the guide track and an extended position wherein the outboard end engages said guide track; and a spring adapted to be attached between the camming element of the crank member and the door for biasing the crank member towards the second rotatable position, the spring adapted to cause the crank member to move towards the second rotatable position and the plunger element to move towards the extended position when tension in the cable is lost.

22. A safety door system for use in a doorway having opposed sides extending from a ground and a top frame spaced above the ground, said system comprising:

a door adapted for disposition within said doorway and movable between a closed position between said opposed sides with a bottom portion adjacent the ground and an open position, said door including face members in generally spaced parallel relationship extending between laterally spaced edges and defining a chamber therebetween;

a guide track adapted for mounting on each of said sides, at least one of said guide tracks comprising a channel operatively connected to the side and a guideway adjacent one of said edges and extending from adjacent said ground to said top frame to define said open position;

guiding members disposed along each of said lateral edges and engaging a guideway;

a plunger element in said chamber with an outboard end disposed adjacent an aperture in a lateral edge of the door, the plunger element being movable between a retracted position, wherein the outboard end is spaced from one of the guide tracks, and an extended position wherein the outboard end is disposed in said guide track;

an actuator having an internal actuator portion disposed in said chamber operably coupled to the plunger element for moving the plunger element between the retracted and extended positions, and an external actuator portion extending outwardly through an aperture in one of said face members, wherein said internal actuator portion includes a shank which is rotatable about an axis substantially transverse to said face members and said external actuator portion comprises a leg which is positioned substantially transverse to the axis of said shank, said leg being rotatable with said shank; and a counterbalancing mechanism outside of said chamber for counteracting the effect of gravity on the door and for controlling the movement of the door between the closed and the open positions, the counterbalancing mechanism including a tensioning member adapted to extend from above said doorway to said external actuator portion, the tensioning member biasing said internal actuator portion to urge the plunger element towards said retracted position when tension is present therein and the internal actuator portion urging the plunger element towards the extended position when tension in the tensioning member is lost.

23. The safety door system of claim 22 wherein said plunger element is freely movable between said retracted and said extended positions and said internal actuator portion includes a camming element which operatively engages the plunger element for actuation between said positions.

24. The safety door system of claim 22 including an engagement member disposed within said channel and positioned for engagement by said plunger element as it moves to the extended position.

25. A safety door system for use in a doorway having opposed sides and a top frame spaced above ground, said system comprising:

a door adapted for disposition within said doorway and movable between a closed position between said opposed sides with a bottom portion adjacent the ground and an open position, said door including a frame and face members in generally spaced parallel relationship on said frame extending between laterally spaced edges to define a chamber therebetween;

a guide track adapted for mounting on each of said sides at least one of said guide tracks comprising an outwardly disposed channel and a guideway adjacent one of said edges and extending beyond said top frame to define said open position;

guiding members disposed along said lateral edges and engaging a guideway;

a plunger element in said chamber with an outboard end disposed adjacent an aperture in a lateral edge of the door, the plunger element being freely movable between a retracted position, where the outboard end is spaced from one of the guide tracks, and an extended position where the outboard end is disposed in said guide track;

a actuator having portions disposed in said chamber operably coupled to the plunger element for moving the plunger element between the retracted and engaged positions, said actuator including a shank portion supported in said chamber for rotation about an axis which is substantially transverse to said face members and having a portion extending outwardly through an aperture in one of said face members, said actuator including a camming portion engaging said plunger element and a leg portion which is disposed substantially transverse to said shank and rotatable therewith outside of said chamber; and a counterbalancing mechanism outside of said chamber for counteracting the effect of gravity on the door and for controlling the movement of the door between the open and closed positions, the counterbalancing mechanism including a tensioning member adapted to extend from above said doorway to said leg portion, the tensioning member being secured to said leg portion and biasing said camming portion to urge the plunger element towards the retracted position when tension is present therein and the actuator urging the plunger element towards the extended position when tension in the tensioning member is lost.

26. A drop-catch mechanism for use with a door which is movable between an open position and a closed position relative to a doorway defined by guide tracks, the door having opposed lateral edges, at least one extension member which extends between the opposed lateral edges, guiding members disposed along the opposed lateral edges each of which engages one of said guide tracks in the doorway, at least one of said guide tracks comprising a guideway and a channel, and a counterbalancing mechanism for counteracting the effect of gravity on the door and for controlling the movement of the door between the open and closed positions, the counterbalancing mechanism including a tensioning member, the drop-catch mechanism preventing free-fall of the door when tension in the tensioning member is lost, the drop catch mechanism comprising:

a plurality of spaced-apart bolts adapted to be disposed in said guide track;

a plunger element with an outboard end adapted to be disposed adjacent one of the opposed lateral edges of the door, the plunger element being movable between a retracted position, wherein the outboard end is adapted to be spaced-apart from a guide track having a channel, and an extended position, wherein the outboard end is adapted to engage at least one of the bolts; and an actuator operably coupled to the plunger element and to the tensioning member for moving the plunger element between the retracted and extended positions, the tensioning member biasing the plunger element towards the retracted position when tension is present therein and the actuator moving the plunger element towards the extended position when tension in the tensioning member is lost.

* * * * *